US011618628B2

(12) United States Patent
Paul

(10) Patent No.: US 11,618,628 B2
(45) Date of Patent: Apr. 4, 2023

(54) PERSONAL HYGIENE PRODUCT DISPOSAL APPARATUS

(71) Applicant: Shannon M. Paul, Henderson, NV (US)

(72) Inventor: Shannon M. Paul, Henderson, NV (US)

( * ) Notice: Subject to any disclaimer, the term of this patent is extended or adjusted under 35 U.S.C. 154(b) by 206 days.

(21) Appl. No.: 17/203,896

(22) Filed: Mar. 17, 2021

(65) Prior Publication Data

US 2022/0297932 A1 Sep. 22, 2022

(51) Int. Cl.

| | |
|---|---|
| ***B65F 1/06*** | (2006.01) |
| ***B65F 1/16*** | (2006.01) |
| ***B65F 1/00*** | (2006.01) |

(52) U.S. Cl.

CPC ..... *B65F 1/062* (2013.01); *B65F 1/006* (2013.01); *B65F 1/16* (2013.01); *B65F 2210/138* (2013.01)

(58) Field of Classification Search

CPC .... B65F 1/062; B65F 1/00; B65F 1/04; B65F 1/141; B65F 1/1426; B65F 1/1431; B65F 1/16; B65F 2240/164

See application file for complete search history.

(56) References Cited

U.S. PATENT DOCUMENTS

| | | | | |
|---|---|---|---|---|
| 5,950,818 | A | 9/1999 | Paulsen | |
| 5,988,386 | A | 11/1999 | Morrow | |
| 6,739,114 | B2 * | 5/2004 | Shaffer | B65F 1/1415 53/244 |
| 8,282,280 | B2 | 10/2012 | Germanow | |
| 8,845,970 | B2 | 9/2014 | Muderick | |
| 9,033,176 | B2 | 5/2015 | Liistro | |
| 2015/0068165 | A1 * | 3/2015 | Chomik | B65F 1/1405 220/495.07 |
| 2017/0050404 | A1 * | 2/2017 | Henken | B65F 1/1607 |
| 2019/0031437 | A1 * | 1/2019 | Belda Mora | B65F 7/00 |
| 2022/0219891 | A1 * | 7/2022 | Yao | B65F 1/16 |
| 2022/0258902 | A1 * | 8/2022 | Yao | B65B 51/10 |

* cited by examiner

*Primary Examiner* — Javier A Pagan

(57) ABSTRACT

A personal hygiene product disposal apparatus for sealing personal hygiene products in a sanitary manner includes a housing having a housing inside. A plurality of doors is coupled to the housing and comprises a first door coupled to a first aperture extending through the housing front side, a second door coupled to a second aperture extending through the housing front side, and a third door coupled to a third aperture extending through the housing front side. A bag dispenser is coupled within the housing inside adjacent the first aperture. The bag dispenser has a waste bag accessible through the bag slot and is configured to receive a personal hygiene product. A bag sealer is coupled within the housing inside adjacent the second aperture. A cutter is coupled within the housing inside adjacent the third aperture. The cutter separates the sealed portion of the waste bag for removal from the apparatus.

10 Claims, 9 Drawing Sheets

PERSONAL HYGIENE PRODUCT DISPOSAL APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to disposal devices and more particularly pertains to a new disposal device for sealing personal hygiene products in a sanitary manner.

(2) Description of Related Art Including Information Disclosed Under 37 CFR 1.97 and 1.98

The prior art relates to disposal devices.

BRIEF SUMMARY OF THE INVENTION

An embodiment of the disclosure meets the needs presented above by generally comprising a housing having a housing front side separated from a housing back side, a housing top side separated from a housing bottom side, and a housing left side separated form a housing right side defining a housing inside. A plurality of doors is coupled to the housing. The plurality of doors comprises a first door coupled to the housing and being pivotably coupled to a first aperture extending through the housing front side. A second door is coupled to the housing. The second door is pivotably coupled to a second aperture extending through the housing front side below the first aperture. A third door is coupled to the housing. The third door is pivotably coupled to a third aperture extending through the housing front side below the second aperture. A bag dispenser is coupled within the housing inside adjacent the first aperture. The bag dispenser has a dispenser front wall lying coplanar with the housing front side and a bag slot extending through the front wall. The bag dispenser has a waste bag accessible through the bag slot and is configured to receive a personal hygiene product. A bag sealer is coupled within the housing inside adjacent the second aperture. The bag sealer has a heating element to form a sealed portion of the waste bag. A cutter is coupled within the housing inside adjacent the third aperture. The cutter separates the sealed portion of the waste bag for removal from the apparatus.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
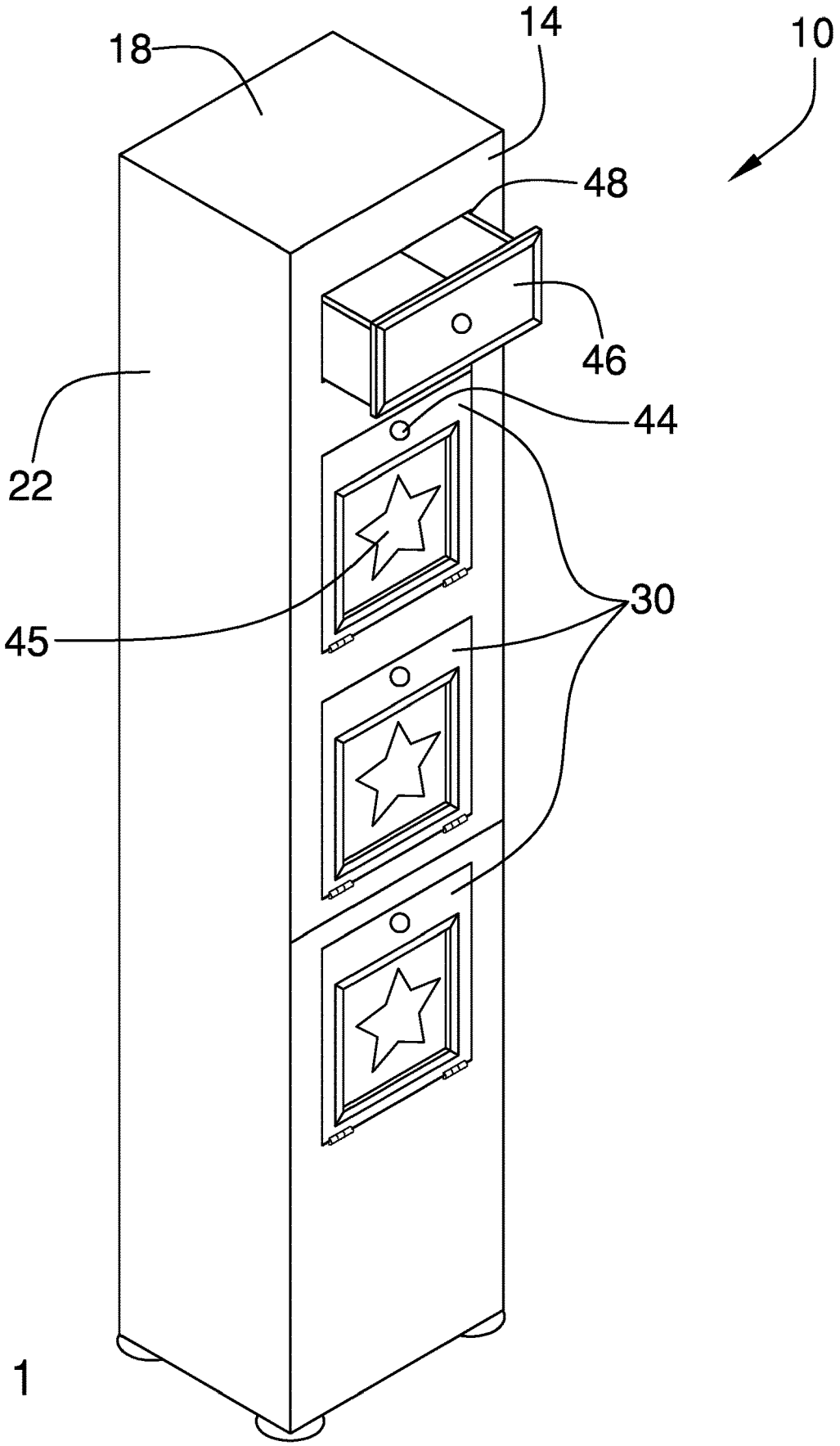
FIG. 1 is an isometric view of a personal hygiene product disposal apparatus according to an embodiment of the disclosure.
Figure 2:
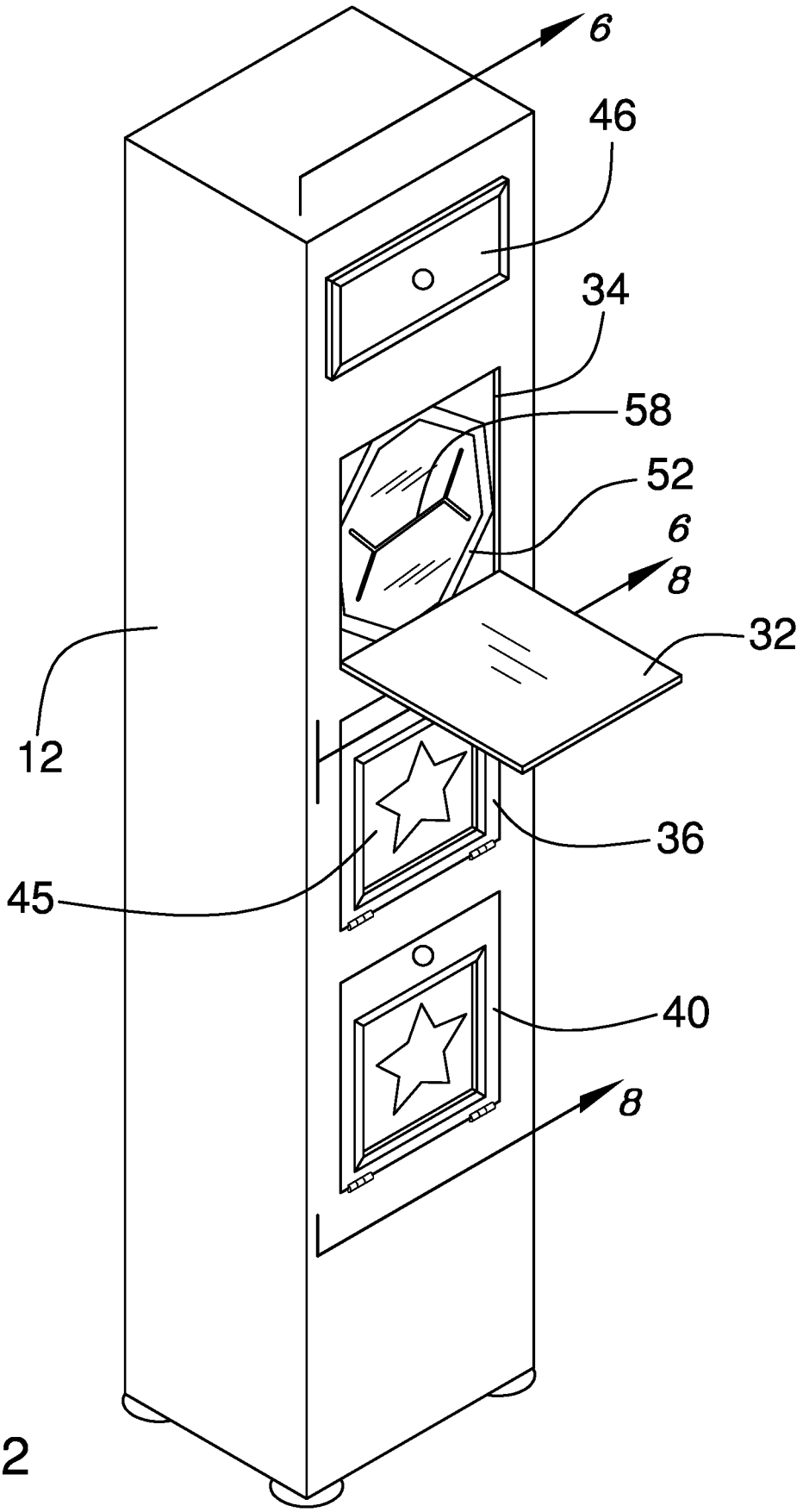
FIG. 2 is an isometric view of an embodiment of the disclosure.
Figure 3:
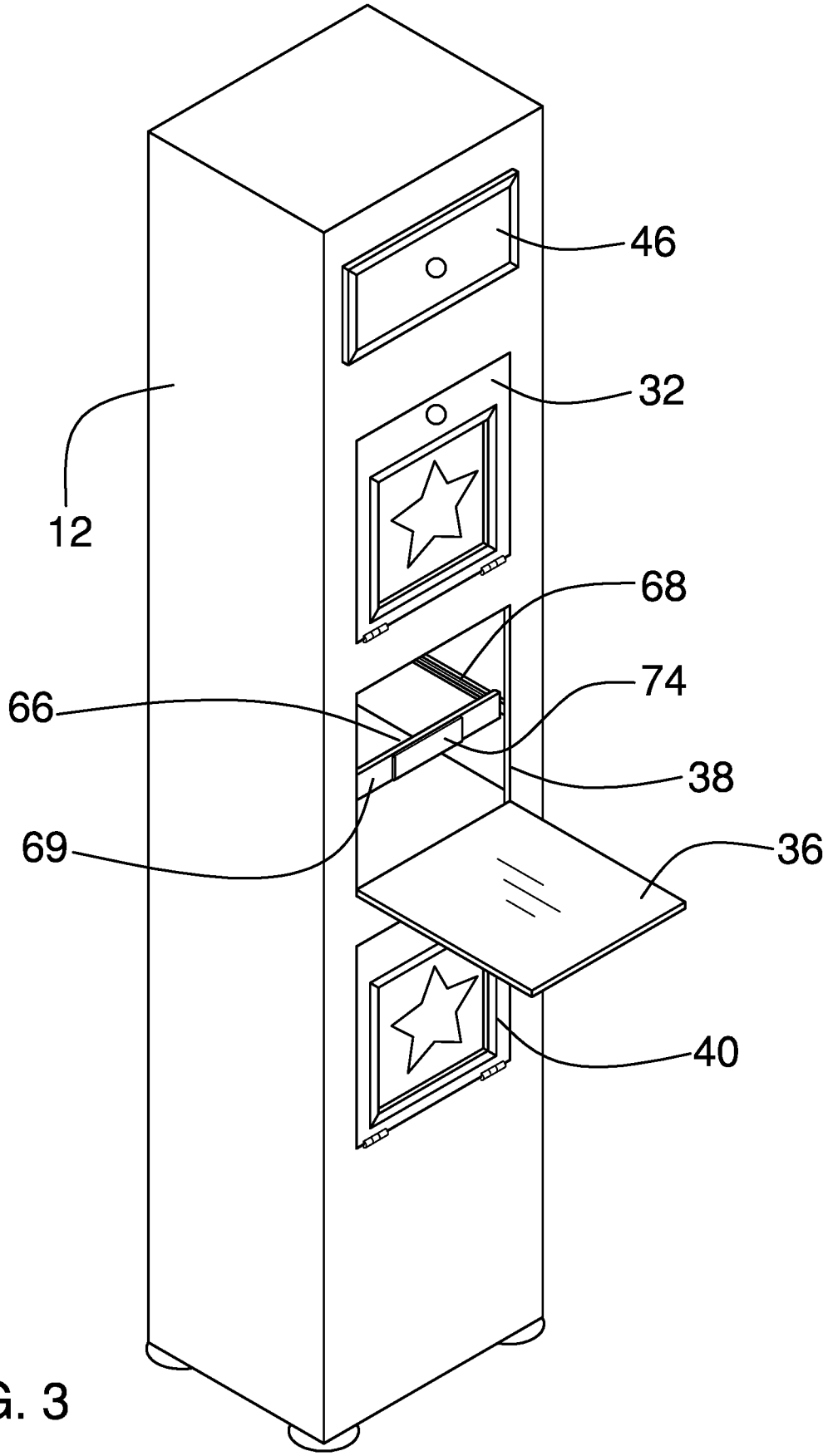
FIG. 3 is an isometric view of an embodiment of the disclosure.
Figure 4:
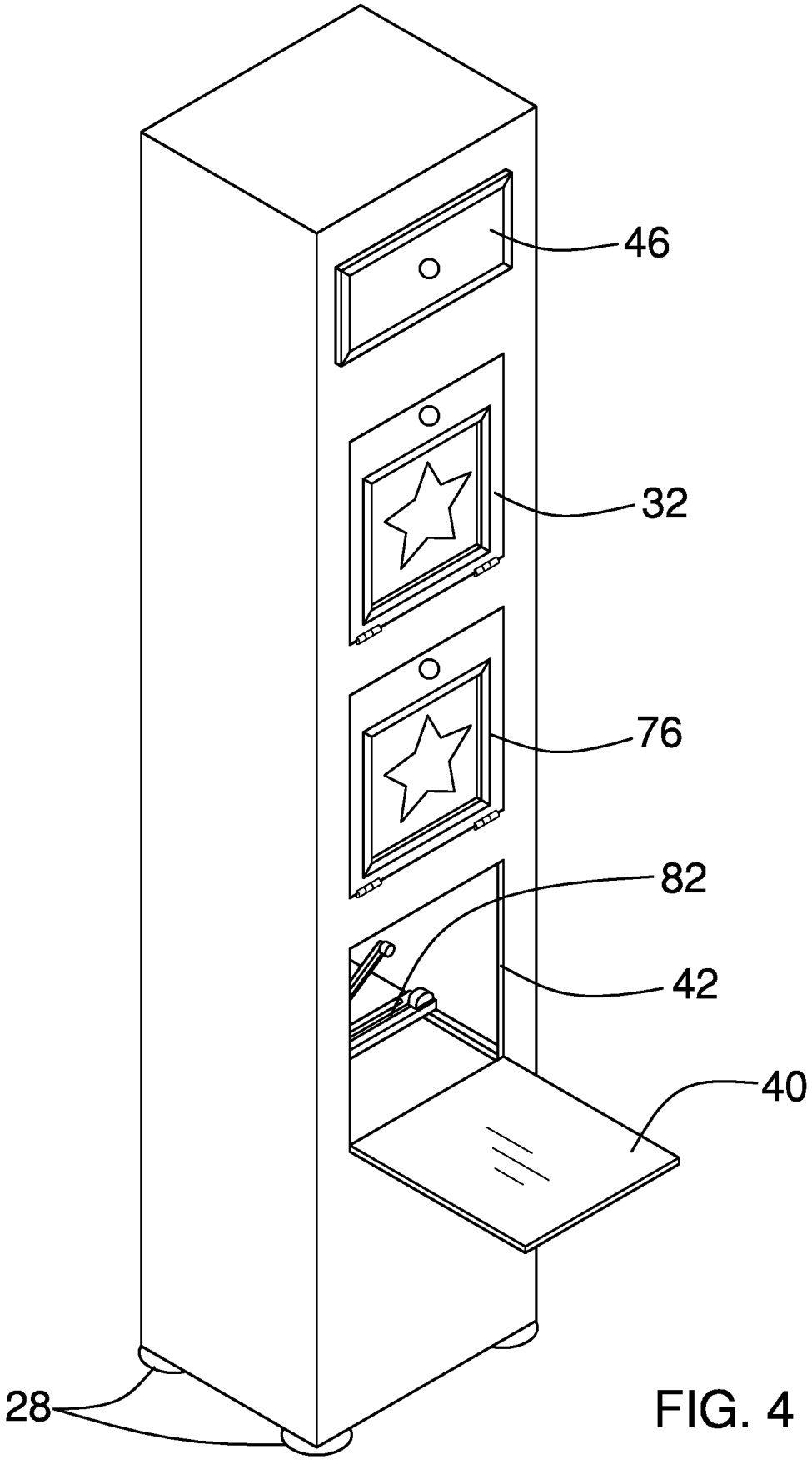
FIG. 4 is an isometric view of an embodiment of the disclosure.
Figure 5:
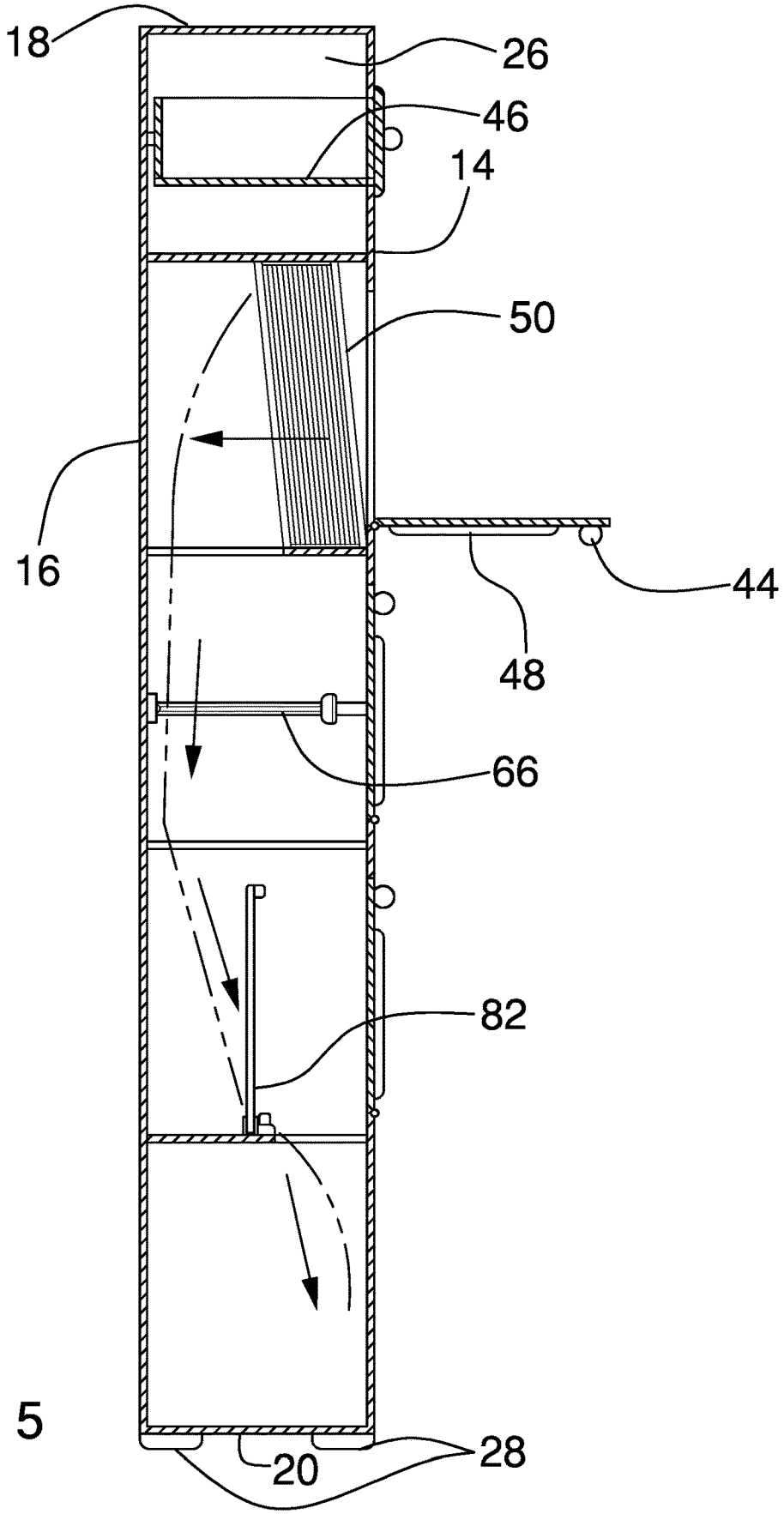
FIG. 5 is a cross-sectional view of an embodiment of the disclosure.
Figure 6:
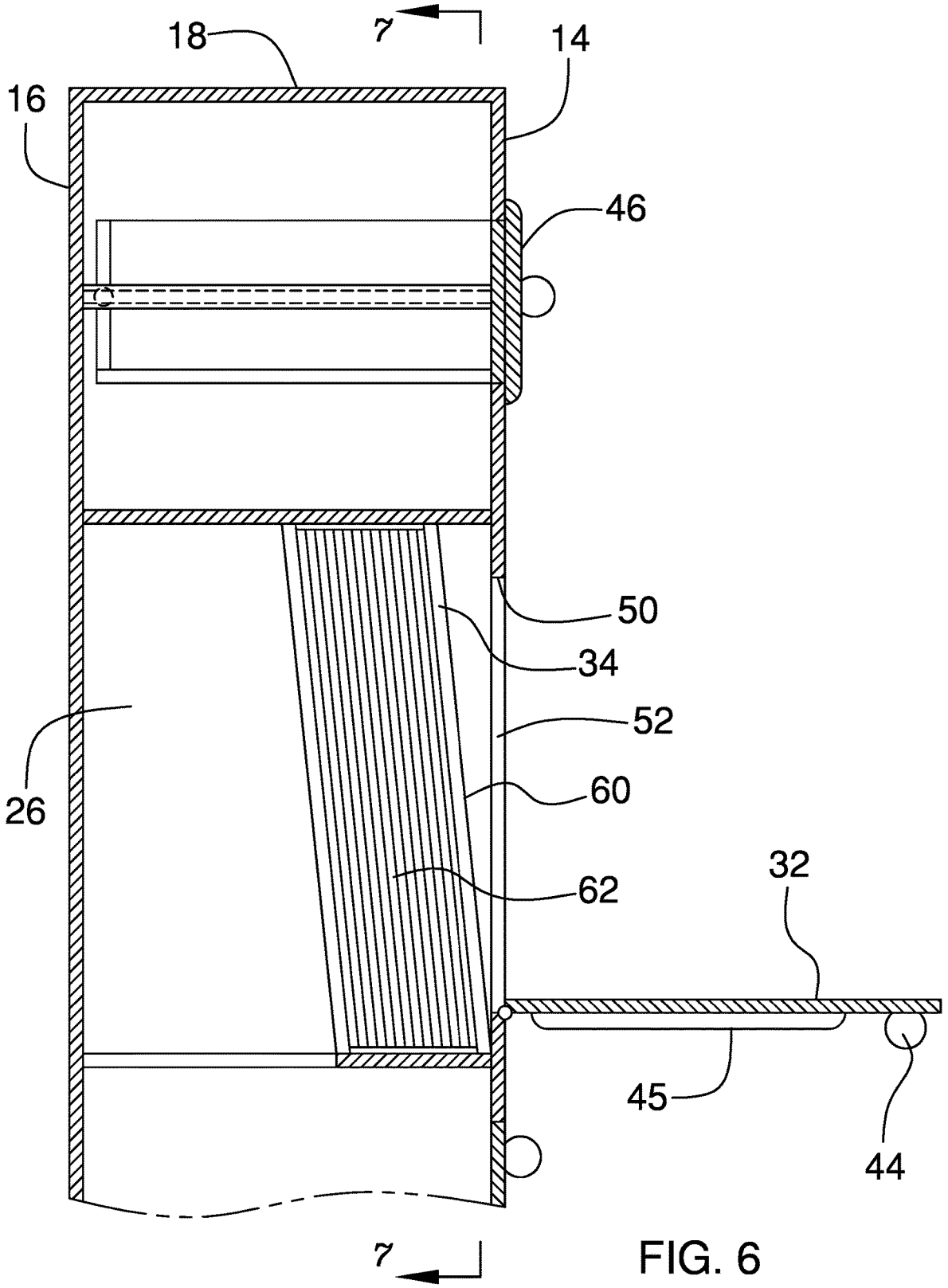
FIG. 6 is a cross-sectional view along the line 6-6 of FIG. 2 of an embodiment of the disclosure.
Figure 7:
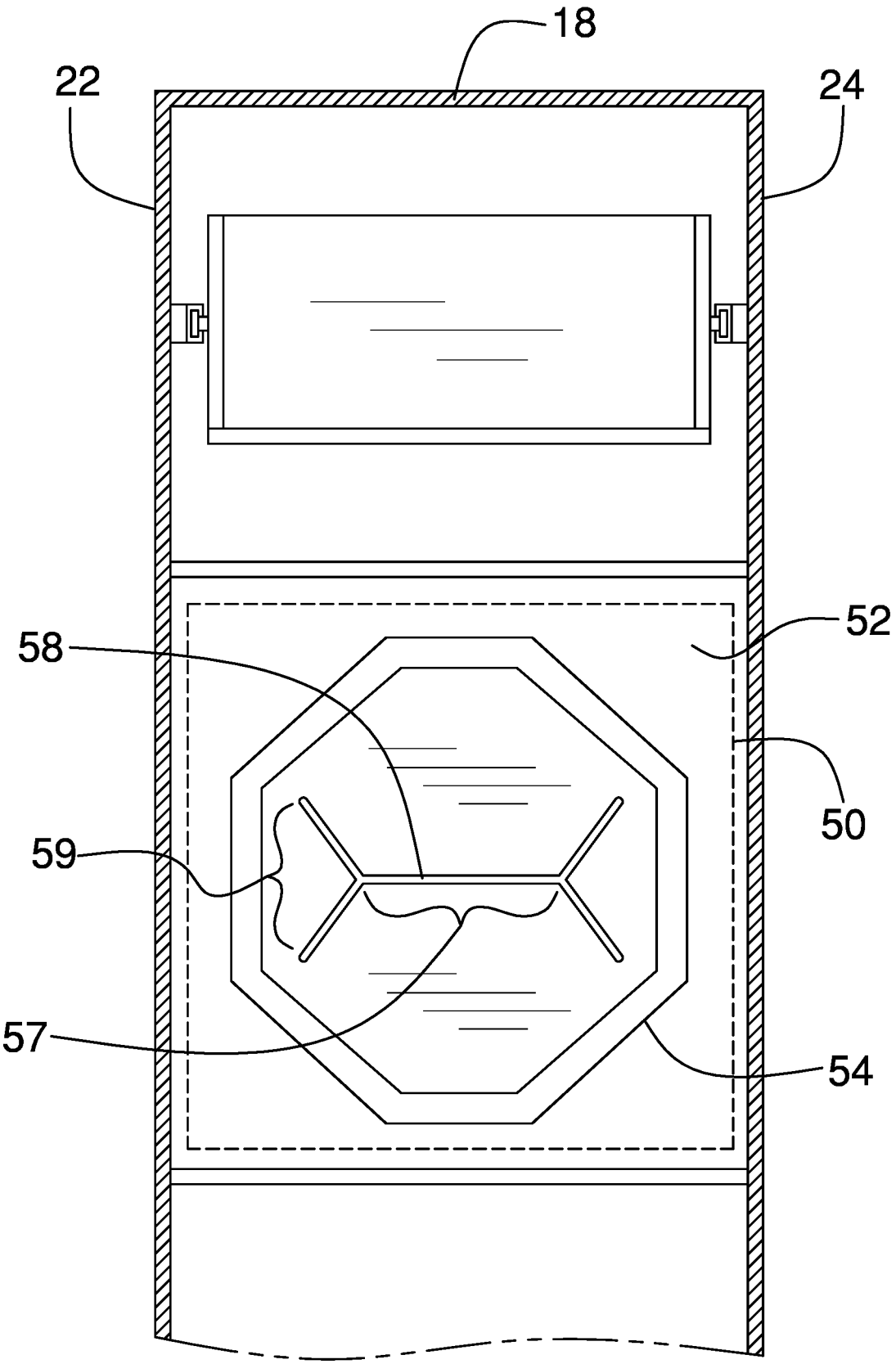
FIG. 7 is a cross-sectional view along the line 7-7 of FIG. 6 of an embodiment of the disclosure.
Figure 8:
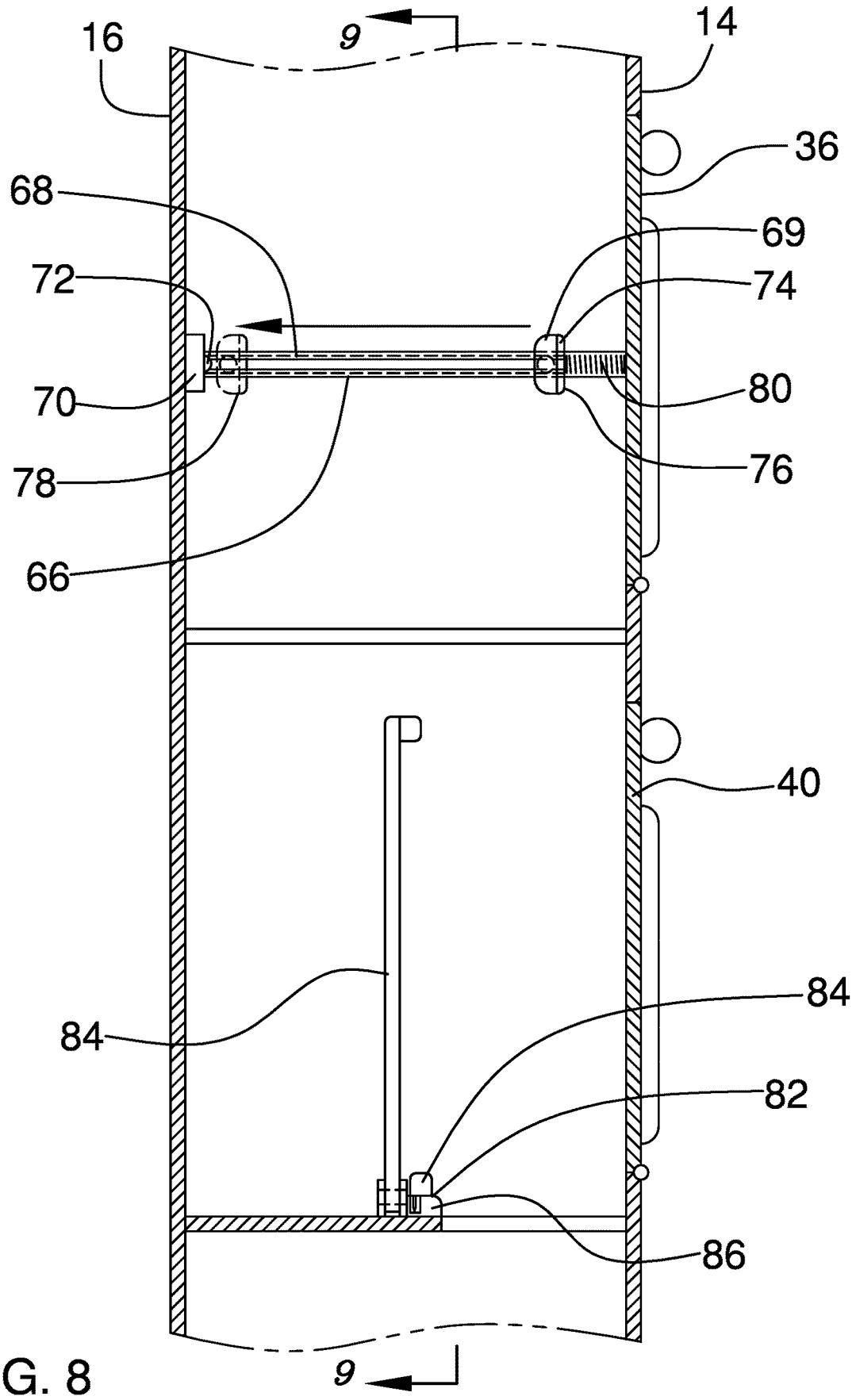
FIG. 8 is a cross-sectional view along the line 8-8 of FIG. 2 of an embodiment of the disclosure.
Figure 9:
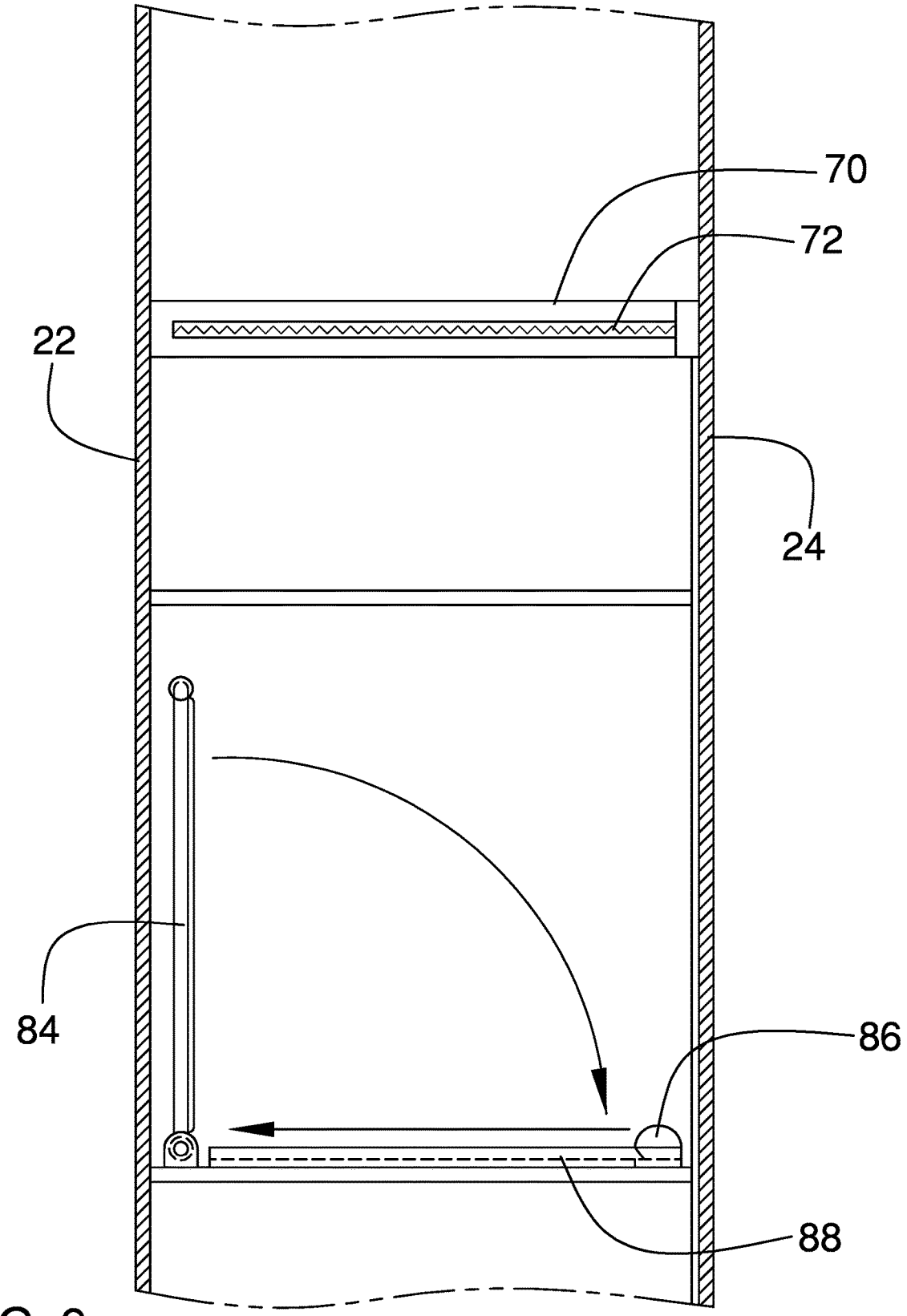
FIG. 9 is a cross-sectional view along the line 9-9 of FIG. 8 of an embodiment of the disclosure.

With reference now to the drawings, and in particular to FIGS. 1 through 9 thereof, a new disposal device embodying the principles and concepts of an embodiment of the disclosure and generally designated by the reference numeral 10 will be described.

As best illustrated in FIGS. 1 through 9, the personal hygiene product disposal apparatus 10 generally comprises a housing 12 having a housing front side 14 separated from a housing back side 16, a housing top side 18 separated from a housing bottom side 20, and a housing left side 22 separated form a housing right side 24 defining a housing inside 26. A plurality of feet 28 is coupled to the housing bottom side 20. Each foot 28 may be a slider foot to more easily move the apparatus 10. A plurality of doors 30 is coupled to the housing 12 and comprises a first door 32 coupled to the housing 12. The first door 32 is pivotably coupled to a first aperture 34 extending through the housing front side 14. A second door 36 is coupled to the housing 12.

The second door 36 is pivotably coupled to a second aperture 38 extending through the housing front side 14 below the first aperture 34. A third door 40 is coupled to the housing 12. The third door 40 is pivotably coupled to a third aperture 42 extending through the housing front side 14 below the second aperture 38. Each door 30 has a spherical knob 44 and a decorative element 45 to turn the apparatus 10 into an aesthetically pleasing piece of furniture.

A storage drawer 46 is slidably coupled through a drawer aperture 48 of the housing front side 14 above the first aperture 34. A bag dispenser 50 is coupled within the housing inside 26 adjacent the first aperture 34. The bag dispenser 50 has a dispenser front wall 52 lying coplanar with the housing front side 14. The front wall 52 has an octagonal frame 54, a flexible membrane 56 coupled within the frame 54, and a bag slot 58 extending through the front wall 52. The bag slot 58 may have a horizontal portion 57 and a pair of V-shaped portions 59. The bag dispenser 50 has an angled bag frame 60 securing a waste bag 62. The waste bag 62 is accessible through the bag slot 58 and is configured to receive a personal hygiene product. The angled bag frame 60 aids the user in pushing the personal hygiene product down to extend the waste bag 62.

A bag sealer 66 is coupled within the housing inside 26 adjacent the second aperture 38. The bag sealer 66 has a guide track 68 coupled to the housing left side 22 and the housing right side 24 and a push bar 69 slidably coupled to the guide track 68. A rear bar 70 is coupled to the housing back side 16 and a heating element 72 is coupled to the rear bar 70. The push bar 69 has a contact pad 74 to activate the heating element 72 when being pushed from a rest position 76 proximal the housing front side 14 to a seal position 78 contacting the rear bar 70. The heating element 72 forms a sealed portion of the waste bag 62. The guide track 68 has a spring 80 to automatically return the push bar 69 to the rest position 76.

A cutter 82 is coupled within the housing inside 26 adjacent the third aperture 42. The cutter 82 has a pivotable security bar 84, a cutter track 86, and a blade 88 slidingly coupled to the cutter track 86. The security bar 84 selectively secures the waste bag 62 to the cutter track 86 and the blade 88 separates the sealed portion of the waste bag 62 for removal from the apparatus 10.

In use, the user opens the first door 32 and inserts the personal hygiene product through the bag slot 58 of the dispenser front wall 52. The personal hygiene product falls into the waste bag 62 of the bag dispenser 50. The angled bag frame 60 aids the user in pushing the personal hygiene product down to extend the waste bag 62. The user opens the second door 36 to access the bag sealer 66. The push bar 69 is pressed to engage the heating element 72 and seal the waste bag 62. The user then opens the third door 40 to access the cutter 82. The security bar 84 is used to secure the waste bag 62 and the blade 88 is slid along the cutter track 86 to separate the waste bag for removal from the apparatus 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal hygiene product disposal apparatus comprising:

a housing, the housing having a housing front side separated from a housing back side, a housing top side separated from a housing bottom side, and a housing left side separated form a housing right side defining a housing inside;

a plurality of doors coupled to the housing, the plurality of doors comprising:

a first door coupled to the housing, the first door being pivotably coupled to a first aperture extending through the housing front side;

a second door coupled to the housing, the second door being pivotably coupled to a second aperture extending through the housing front side below the first aperture; and a third door coupled to the housing, the third door being pivotably coupled to a third aperture extending through the housing front side below the second aperture;

a bag dispenser coupled to the housing, the bag dispenser being coupled within the housing inside adjacent the first aperture, the bag dispenser having a dispenser front wall lying coplanar with the housing front side and a bag slot extending through the front wall, the bag dispenser having a waste bag accessible through the bag slot and configured to receive a personal hygiene product;

a bag sealer coupled to the housing, the bag sealer being coupled within the housing inside adjacent the second aperture, the bag sealer having a heating element to form a sealed portion of the waste bag; and a cutter coupled to the housing, the cutter being coupled within the housing inside adjacent the third aperture, the cutter separating the sealed portion of the waste bag for removal from the apparatus.

2. The personal hygiene product disposal apparatus of claim 1 further comprising a storage drawer coupled to the housing, the storage drawer being slidably coupled through a drawer aperture of the housing front side above the first aperture.

3. The personal hygiene product disposal apparatus of claim 1 further comprising the front wall of the dispenser having an octagonal frame and a flexible membrane coupled within the frame, the bag slot extending through the membrane.

4. The personal hygiene product disposal apparatus of claim 1 further comprising the bag dispenser having an angled bag frame securing the waste bag.

5. The personal hygiene product disposal apparatus of claim 1 further comprising the bag sealer having a guide track coupled to the housing left side and the housing right side and a push bar slidably coupled to the guide track, a rear bar is coupled to the housing back side and the heating element is coupled to the rear bar, the push bar having a contact pad to activate the heating element when being pushed from a rest position proximal the housing front side to a seal position contacting the rear bar.

6. The personal hygiene product disposal apparatus of claim 5 further comprising the guide track having a spring to automatically return the push bar to the rest position.

7. The personal hygiene product disposal apparatus of claim 1 further comprising the cutter having a pivotable security bar, a cutter track, and a blade slidingly coupled to the cutter track, the security bar selectively securing the waste bag to the cutter track and the blade separating the sealed portion.

8. The personal hygiene product disposal apparatus of claim 1 further comprising a plurality of feet coupled to the housing bottom side.

9. The personal hygiene product disposal apparatus of claim 1 further comprising each door having a spherical knob and a decorative element.

10. A personal hygiene product disposal apparatus comprising:

a housing, the housing having a housing front side separated from a housing back side, a housing top side separated from a housing bottom side, and a housing left side separated form a housing right side defining a housing inside;

a plurality of feet coupled to the housing bottom side;

a plurality of doors coupled to the housing, the plurality of doors comprising:

a first door coupled to the housing, the first door being pivotably coupled to a first aperture extending through the housing front side;

a second door coupled to the housing, the second door being pivotably coupled to a second aperture extending through the housing front side below the first aperture; and a third door coupled to the housing, the third door being pivotably coupled to a third aperture extending through the housing front side below the second aperture;

each door having a spherical knob and a decorative element;

a storage drawer coupled to the housing, the storage drawer being slidably coupled through a drawer aperture of the housing front side above the first aperture;

a bag dispenser coupled to the housing, the bag dispenser being coupled within the housing inside adjacent the first aperture, the bag dispenser having a dispenser front wall lying coplanar with the housing front side, the front wall having an octagonal frame, a flexible membrane coupled within the frame, and a bag slot extending through the front wall, the bag dispenser having an angled bag frame securing a waste bag, the waste bag being accessible through the bag slot and configured to receive a personal hygiene product;

a bag sealer coupled to the housing, the bag sealer being coupled within the housing inside adjacent the second aperture, the bag sealer having a guide track coupled to the housing left side and the housing right side and a push bar slidably coupled to the guide track, a rear bar is coupled to the housing back side and a heating element is coupled to the rear bar, the push bar having a contact pad to activate the heating element when being pushed from a rest position proximal the housing front side to a seal position contacting the rear bar, the heating element forming a sealed portion of the waste bag, the guide track having a spring to automatically return the push bar to the rest position; and a cutter coupled to the housing, the cutter being coupled within the housing inside adjacent the third aperture, the cutter having a pivotable security bar, a cutter track, and a blade slidingly coupled to the cutter track, the security bar selectively securing the waste bag to the cutter track and the blade separating the sealed portion of the waste bag for removal from the apparatus.

* * * * *